US007637397B2

(12) United States Patent
Conway et al.

(10) Patent No.: US 7,637,397 B2
(45) Date of Patent: Dec. 29, 2009

(54) FLEXIBLE DOWN TUBE AND METHODS OF USE THEREOF

(75) Inventors: Simon M. Conway, Burlington, WI (US); Kevin Harrity, Oak Creek, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 712 days.

(21) Appl. No.: 11/467,241

(22) Filed: Aug. 25, 2006

(65) Prior Publication Data

US 2008/0047982 A1 Feb. 28, 2008

(51) Int. Cl.
*B05B 11/00* (2006.01)
*B05B 15/00* (2006.01)
*B65D 3/14* (2006.01)

(52) U.S. Cl. ..... 222/382; 222/1; 222/464.3; 222/464.5

(58) Field of Classification Search ..... 222/1, 222/464.1, 464.3–464.5, 464.7, 211, 382
See application file for complete search history.

(56) References Cited

U.S. PATENT DOCUMENTS

| | | | | | |
|---|---|---|---|---|---|
| 750,521 | A | * | 1/1904 | Braymer | 239/342 |
| 1,339,237 | A | * | 5/1920 | Thompson | 222/263 |
| 2,569,975 | A | * | 10/1951 | Cone | 169/72 |
| 4,830,235 | A | | 5/1989 | Miller | |
| 5,186,365 | A | * | 2/1993 | Nolte | 222/153.08 |
| 5,381,961 | A | | 1/1995 | Evans et al. | |
| 5,464,129 | A | | 11/1995 | Ho | |
| 5,518,150 | A | | 5/1996 | Witt, Jr. | |
| 5,522,548 | A | | 6/1996 | Gallien et al. | |
| 5,573,046 | A | * | 11/1996 | Venooker et al. | 141/285 |
| 5,797,522 | A | | 8/1998 | Evans et al. | |
| 5,954,239 | A | | 9/1999 | Evans et al. | |
| 6,027,041 | A | | 2/2000 | Evans | |
| 6,202,943 | B1 | | 3/2001 | Evans et al. | |
| 6,789,303 | B2 | | 9/2004 | Maas et al. | |
| 2001/0022324 | A1 | | 9/2001 | Evans et al. | |

FOREIGN PATENT DOCUMENTS

| | | |
|---|---|---|
| EP | 0687639 A1 | 12/1995 |
| JP | 63-317484 | 12/1988 |

OTHER PUBLICATIONS

PCT/US2007/018700 International Search Report and Written Opinion dated Feb. 1, 2008.

* cited by examiner

*Primary Examiner*—J. Casimer Jacyna

(57) ABSTRACT

Disclosed are liquid dispensing devices suitable for use to dispense liquid from a container. They have a conventional sprayer associated with a flexible down tube. The down tube has an essentially rigid upper section linked to the sprayer, an essentially rigid lower section suitable to extend into the container, and an intermediate flexible section. An essentially rigid member (e.g. a sleeve) is mounted on/to the down tube so as to move between a first position in which it covers the flexible section so as to restrict pivoting of the lower section relative to the upper section, to a second position in which it permits the lower section to pivot relative to the upper section. As the down tube is being inserted in the container a flange on the sleeve is held by the container lip so that the sleeve is caused to move between the two positions. The down tube structure is thus rigid during assembly of the tube with the container, but automatically becomes flexible thereafter. Methods of assembly are also disclosed using these structures.

20 Claims, 4 Drawing Sheets

FLEXIBLE DOWN TUBE AND METHODS OF USE THEREOF

CROSS-REFERENCE TO RELATED APPLICATIONS

Not applicable.

STATEMENT REGARDING FEDERALLY SPONSORED RESEARCH/DEVELOPMENT

Not applicable.

BACKGROUND OF THE INVENTION

The present invention relates to spray dispensers having a flexible down tube to facilitate spraying when a bottle or other container associated with the dispenser is not completely vertical. More particularly it relates to such devices that are configured to facilitate automated, high speed assembly of such dispensers with containers holding the liquids to be dispensed.

A variety of devices are known for delivering liquid from a container. Some rely on aerosol valves to deliver the spray. See e.g. U.S. Pat. No. 5,797,522. Others rely on trigger pump sprayers. See e.g. U.S. Pat. No. 6,789,303. Still others use motorized pumping systems.

Some use a down (a/k/a "pick-up"; a/k/a "dip") tube that extends from the sprayer unit down into the container holding the liquid to be dispensed. The upper end of the down tube is then connected to the sprayer (often to a suction end of a pump). The lower end of the tube is positioned near the bottom of the container.

In such devices a pump will normally suck liquid from a bottle through the down tube and then pump the liquid out a sprayer nozzle. When the bottle is nearly emptied, and the bottle is tilted from vertical (e.g. to spray the upper end of a window being cleaned, or a countertop), the lower end of the down tube can be exposed to air even though there is significant remaining liquid in the bottle. This can lead to air being sucked into the down tube (resulting in an undesired air/liquid foaming mix), or can result in the consumer throwing away the bottle prematurely, or can restrict how a consumer can effectively use the bottle.

As a result the art has sought to make such down tubes flexible, so that if the sprayer bottle is tipped during use the end of the down tube in the bottle will follow any remaining liquid in the bottle. Examples of this include U.S. Pat. Nos. 4,830,235; 5,381,961; 5,464,129; 5,518,150; 5,522,548; 5,797,522; 5,954,239; 6,027,041 and 6,202,943, and U.S. patent application publication 2001/002234. See also JP 63-317484. The disclosure of this patent, and of all other patents and publications referred to herein, are incorporated by reference as if fully set forth herein.

For example, in U.S. Pat. No. 5,381,961 a short, rigid down tube section extends down from the sprayer near the collar of the bottle. At its lower end is mounted a flexible sleeve. That sleeve receives the short section inside one end of it, and at its opposite end receives an elongated section of rigid down tube. The down tube structure is able to pivot at the flexible sleeve "joint". Thus, the lower end of the down tube can "follow" residual liquid in the bottle as the bottle is tipped. This enables almost all of the remaining liquid in the bottle to be sucked up before the down tube will begin to suck air, for most typical positions of the bottle.

While flexible pick-up tubes of this type are quite advantageous, there is some difficulty in assembling them with the bottles when using high speed, automated equipment. In this regard, the pivoting capability for the down tube which is so advantageous once the product is assembled makes the assembly of the down tube/sprayer subassembly with the bottle more complex than in the case of a rigid down tube. This can slow line speed, require specialized equipment, and/or create occasional breakage during the assembly process.

As such, a need exists for improved flexible down tube assemblies, particularly those which permit desired pivoting characteristics once installed but are more suitable for use in a high speed assembly line.

BRIEF SUMMARY OF THE INVENTION

In one aspect the invention provides a liquid dispensing device suitable for use to dispense liquid from a container. The container is of a type having a bottom wall, side wall structure, an internal reservoir cavity and an upper opening. The liquid dispensing device has a sprayer and a down tube having an essentially rigid upper section linked to the sprayer, an essentially rigid lower section suitable to extend into the internal reservoir cavity, and an intermediate flexible section. There is also an essentially rigid sleeve mounted along the down tube so as to move between a first position in which it covers at least a portion of the flexible section so as to restrict pivoting of the lower section relative to the upper section, and a second position in which it permits the lower section to pivot relative to the upper section.

In preferred forms the sleeve has a radial projection, such as a circular or other shaped flange, that is suitable to engage the container adjacent its upper opening (preferably its upper lip) so as to drive the sleeve from the first position to the second position as the down tube is being inserted in the internal cavity.

The down tube structure can be varied. For example, it can be formed from three separate pieces (e.g. two plastic rigid sections with an intermediate flexible tube section). Alternatively, the down tube can be a single piece in which an intermediate portion of the tube has thinned walls relative to its upper and lower sections (so as to permit the flexing at the narrowed wall portion). In another form the thinned wall section plus a separate flexible tube can both be used at the intermediate portion.

The exact nature of the sprayer selected is not critical. The most preferred intended utility of the invention is in connection with trigger operated sprayers (consider for example the sprayer unit at FIG. 10 of U.S. Pat. No. 6,789,303).

Also most preferably the invention can be applied to form containers that contain liquids suitable for varied home use and automotive applications. For example, the containers could contain hard surface cleaners (e.g. a cleaner containing a water/surfactant mix). One most preferred container would hold an aqueous surfactant-based cleaning solution such as Windex® brand window cleaner, available from S.C. Johnson & Son, Inc.

Alternatively, the container could contain other surface treating chemicals besides just cleaners, such as would be present in a furniture polish or the like. Also, the liquid could serve other non-cleaning functions such as insect control (e.g. a spray of water mixed with an insect repellent such as limonene).

In another form the invention provides methods of assembling such a liquid dispensing device with a container having a bottom wall, side wall structure, an internal reservoir cavity, liquid in the cavity and an upper opening. One obtains such a container and also a liquid dispensing device. One then inserts the down tube of such a device into the internal reservoir cavity of the container. This moves the essentially rigid member/sleeve from a first position in which it restricted pivoting of the lower section relative to the upper section during the inserting step, to a second position where it permits the lower section to pivot relative to the upper section in the internal cavity. Most preferably during this moving step a flange of the rigid member contacts the container, to thereby restrict downward movement of the flange while driving the rigid member up along the down tube as the down tube is inserted in the internal cavity.

When the down tube of the present invention is fully assembled with the container the lower end of the down tube will be free to sway/pivot/flex as the container is tipped, even though the lower end of the dip tube is rigid. However, importantly, the overall down tube structure can be essentially rigid during the assembly of the sprayer/down tube subassembly with the bottle. This permits conventional equipment to be used to assemble the sprayer to the bottle, and further permits higher line speeds to be consistently used.

The down tube rigid sections may be of a conventional down tube material. For example, one may use high density polyethylene, polypropylene, or another plastic that is compatible with the liquid.

The flexible tubing can be made of any substantially flexible material that provides sufficient sway for the flexible tubing, albeit with the material being selected to be compatible with the selected liquid. For most applications it can be formed from materials such as latex, neoprene, silicone, and thermoplastic elastomers such as Santoprene brand thermoplastic elastomer.

The sleeve/flange member can be inexpensively produced and reliably used. For example, it can be formed of a plastic such as high density polyethylene, polypropylene, nylon, etc. As will be discussed below, there are sealing advantages to selecting a material for the flange member which is softer than the material against which it will abut.

The overall assembly is particularly well suited for use with axial insertion machinery of the type that is conventionally used for inserting simpler rigid down tubes into such containers. Thus, the assembly does not impose additional significant equipment acquisition costs beyond those experienced for use with conventional down tubes that are not flexible, and in any event permits such machinery to be used more efficiently in connection with flexible down tubes.

These assemblies are constructed so that the sprayer can be removably attached (preferably threaded) to the container. This permits the container to be refilled when empty, or alternatively replaced by another filled container, without the need to dispose of the sprayer unit (which can have a much longer useful life).

The foregoing and other advantages of the invention will become apparent from the following description. In the following description reference is made to the accompanying drawings in which there is shown by way of illustration preferred embodiments of the invention. These embodiments do not represent the full scope of the invention. Reference should therefore be made to the claims herein for interpreting the scope of the invention.

DETAILED DESCRIPTION OF THE PREFERRED EMBODIMENTS

Figure 1:
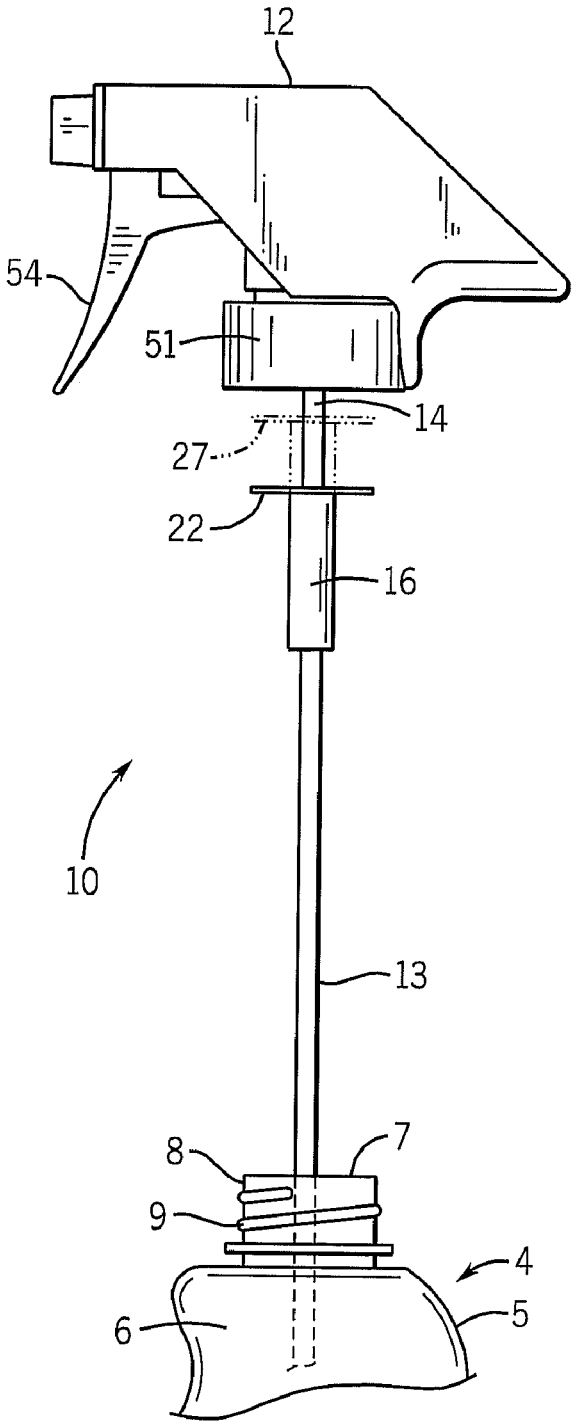
FIG. 1 is an exploded, frontal view of the liquid dispensing device of the present invention, shown as it is being mounted on a container.

The dispenser of the present invention is suitable for use with a conventional container 4 having a conventional bottom wall (not shown), side wall structure 5, internal cavity 6, upper opening 7 and associated lip 8. See also U.S. Pat. No. 5,518,150 for the example of other containers.

As can be seen from FIG. 1, a down tube assembly 10 of the present invention is designed to be linked to sprayer/liquid dispenser 12. The down tube assembly 10 of this embodiment comprises an essentially rigid lower section 13, an essentially rigid upper section 14, and (as can be seen for example from FIG. 2) an intermediate flexible section 15 in the form of a flexible tubular sleeve. The lower end 26 of upper section 14, the upper end 28 of lower section 13, and the intermediate flexible section 15, are surrounded by a rigid sleeve 16 when the dispensing device is ready for assembly to the container.

The upper end 18 of the intermediate flexible section 15 and the lower end 20 of the intermediate flexible section 15 are, in this configuration, within the axial extent of the sleeve 16. As a result, in this "first position", upper section 14 is not free to pivot relative to lower section 13.

Figure 2:
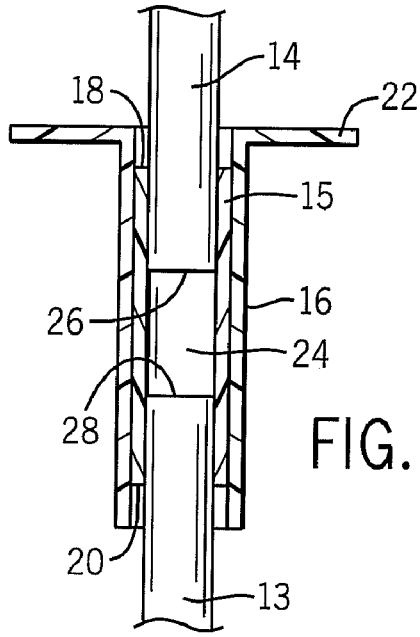
FIG. 2 is an enlarged frontal view, partially in section, of a portion of the down tube and sleeve construction, showing these parts as configured at the FIG. 1 stage of assembly.

Note also that in the FIG. 2 embodiment the sleeve 16 also has a rigid circular flange 22 which projects radially outwardly. As a result, as the dispenser, first lead by the lower section 13, is inserted into the container 4 through the opening 7. The sleeve portion 16 is sized to also pass into and through the opening 7. However, the flange 22 is sized large enough so as to be unable to pass the lip 8. Hence, the lip 8 will hold the flange 22, and thus the sleeve 16, from further downward movement, even while the down tube assembly 13/14/15 continues to move downward. This drives the sleeve axially up the down tube.

This will ultimately preferably move the sleeve 16 above the gap area 24 defined between ends 26 and 28. As a result, in this "second position", the lower section 13 will be able to pivot freely relative to the bottle and the upper section 14. The dotted lines 27 in FIG. 1 illustrate axial movement of the sleeve that will occur.

Figure 4:
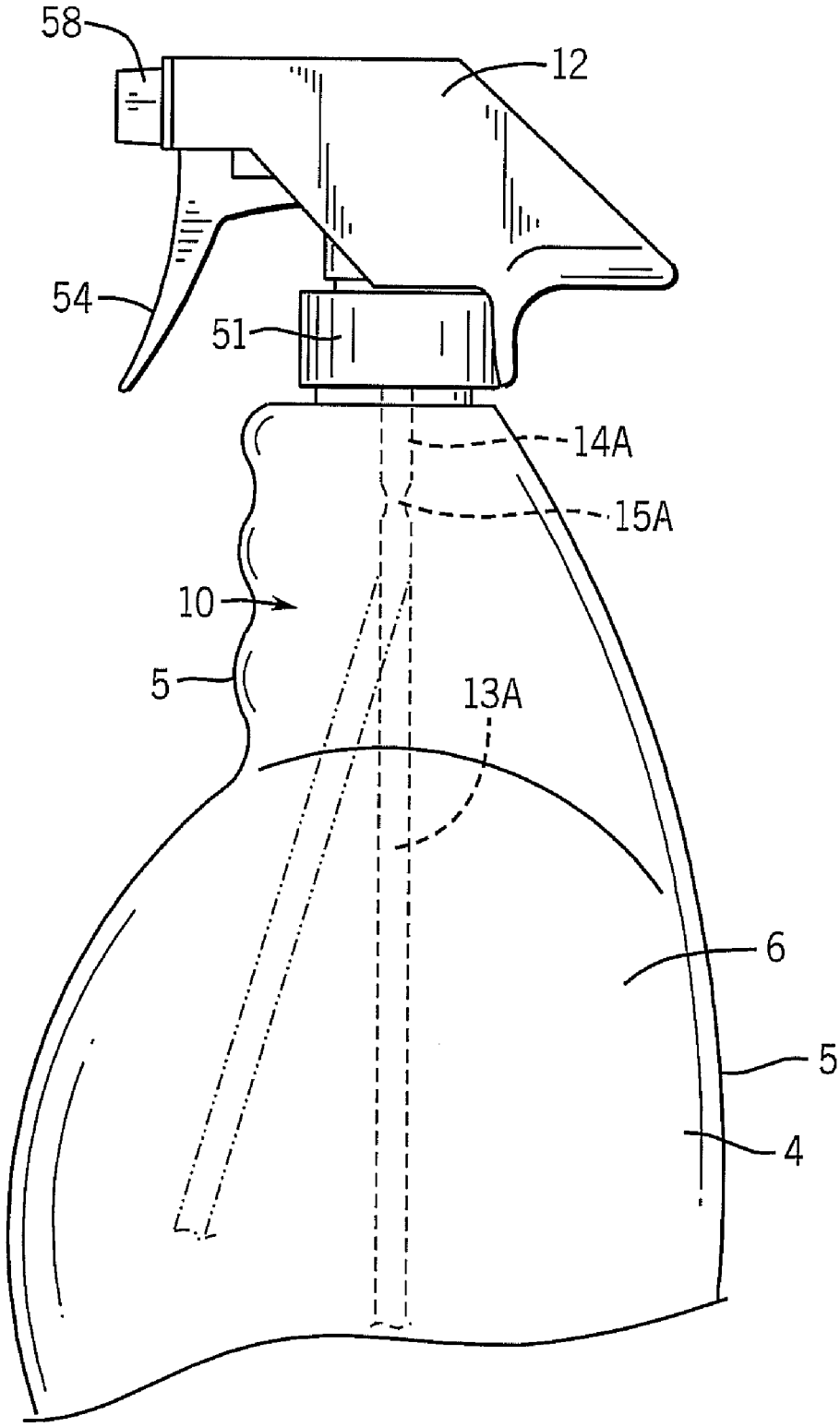
FIG. 4 is a frontal view of a third embodiment of the liquid dispensing device of the present invention.

Once the liquid dispensing device is positioned in a bottle like that shown in FIG. 4, it can operate in a conventional spray manner when a consumer pumps the trigger 54 to cause an internal pump in the spray head to deliver spray out nozzle 58. Note that in this position the sleeve is axially above the flexible connection. Hence, when the consumer removes the sprayer to refill the bottle or use a new bottle, the dip tube assembly can be reinserted in a new bottle (or the refill bottle). However, at this point the assembly will be flexible, requiring some care during the insertion.

Figure 3A:
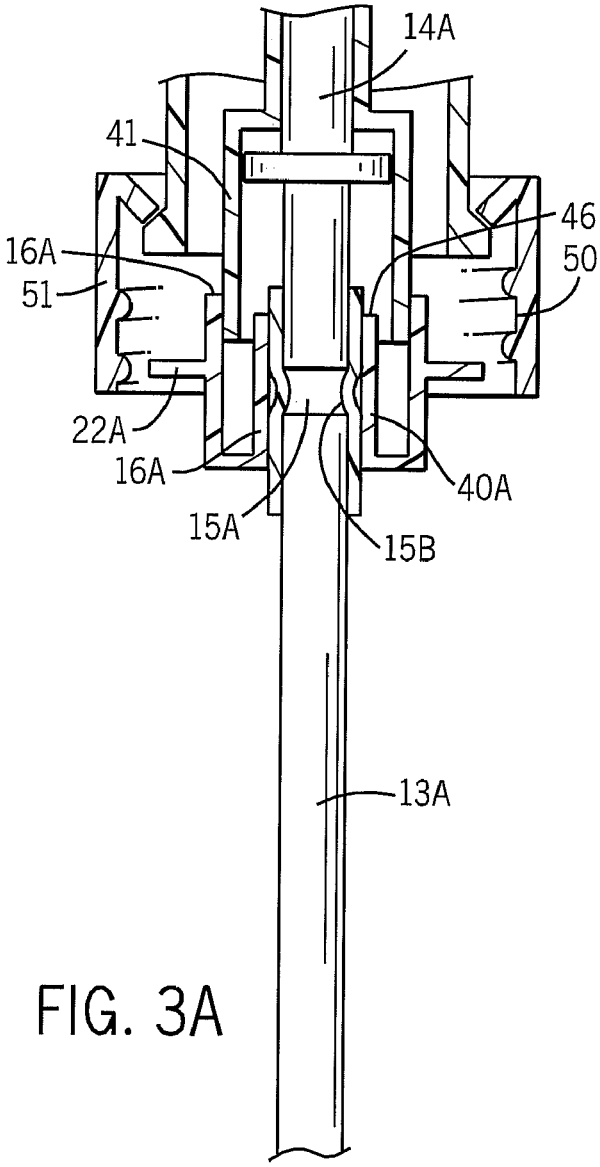
FIG. 3A shows a detailed frontal view, partially in section, of a portion of a second embodiment of the liquid dispensing device of the present invention, shown in a shipping position for shipping the trigger and dip tube to a container filling site.

FIG. 3A depicts a first alternative embodiment in which the down tube is a single piece structure having an upper section 14A, a lower section 13A, a thinned intermediate flexible section 15A, and a flexible intermediate connection element 15B. Here the flexibility results from both a flexible connector and an integral thinned section. If desired the connector 15B can be completely omitted as shown in FIG. 4. However, this would require special care in forming the thinned out walls, and might lessen the useful life of the connection.

Figure 3B:
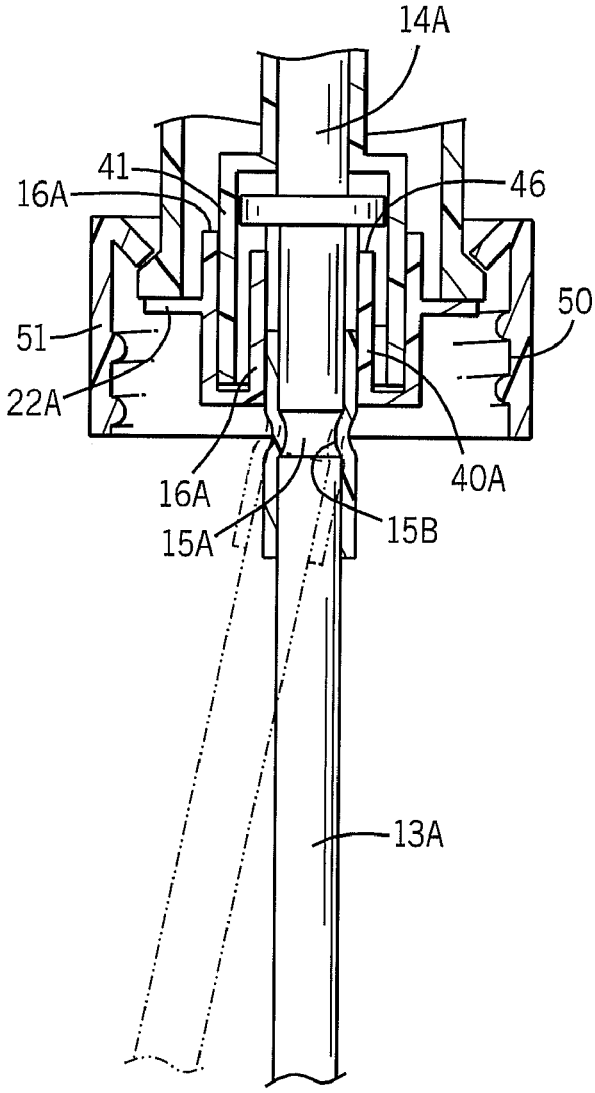
FIG. 3B shows a detailed frontal view, partially in section, similar to FIG. 3A with the second embodiment of the liquid dispensing device in an "in use" position.

In the FIG. 3A the embodiment is shown in a shipping position for shipping the trigger and dip tube to a container filling site, and in FIG. 3B the embodiment is shown in an "in use" position. In this embodiment, the rigid member/sleeve 16A is a somewhat more complex structure than the corresponding part 16 in FIG. 2. A circular flange 22A is designed to abut against a lip 8 of the container. Here a wall 40A of this element will telescope into an additional receiving member 41, with a positive stop of the sleeve movement occurring due to abutment of flange 22A with a wall 57 of the sprayer (see FIG. 3B).

Sleeve 16A rides closely against the outside of wall 41. This close fit provides an small amount of resistance to the movement, preventing accidental or unintentional movement. The force created by flange 22A being pushed upwards by the lip 8 is sufficient to overcome this resistance.

The assembly of FIGS. 3A and 3B has a liquid seal at the top of flange 22A against the bottom wall 57 of the trigger housing when the assembly is completed. Further, the bottom of flange 22A has a liquid seal against the top of the lip 8 of the container 4 when the assembly is completed. This can also be achieved by making flange 22A from a softer material than either the trigger housing wall 57 or the lip 8 of the container 4. Alternatively, the assembly can be provided with gaskets above and below the flange 22A (compare the embodiment of FIG. 5).

As mentioned above, the shipping position for shipping the trigger and dip tube to the container filling site is shown in FIG. 3A. During shipment of the dip tube/trigger assembly (without the container), the flange 22A of the sleeve 16A is preferably inside the screw cap 51 to limit side to side movement of the sleeve/dip tube assembly. Upon insertion into a filled container, the lip 8 of the container 4 pushes the flange 22A upward and exposes the flexible section 15A and the flexible intermediate connection element 15B. The bottom of the sleeve 16A should be high enough that at least part of the flexible section 15A and the flexible intermediate connection element 15B are exposed so the bottom portion of the dip tube 13A can tilt to follow gravity and the liquid in the container 4.

FIGS. 3A and 3B show the difference between the in shipment/high speed insertion/rigid position (FIG. 3A) and the in use/tiltable position (FIG. 3B). When the sleeve 16A is down (FIG. 3A), the sleeve 16A prevents the dip tube section 13A from flopping during assembly of the trigger to the container by covering the flexible section 15A and the flexible intermediate connection element 15B. Also, when the sleeve 16A is down (FIG. 3A), the flange 22A is wide enough to minimize side to side movement due to its placement inside the screw cap 51 of the trigger assembly. When the sleeve 16A is up (FIG. 3B), the sleeve 16A not only permits the dip tube to tilt in use, but also the sleeve 16A attaches to the trigger to help secure the dip tube 13A in shipping.

In FIG. 4 there is shown a fully assembled device using the FIGS. 3A & 3B embodiment, albeit without connector 15B. As can be seen, in this embodiment the thinned out portion of the intermediate flexible section 15A permits the pivoting of the down tube lower section 13A.

After the down tube 10 has been inserted into a container 4, the sprayer 12 is preferably secured to the container 4 using any means known to the art. For example, as best seen in FIGS. 1 and 3A, the container 4 may have threads 9 at its upper end which mate with threads 50 on a cap 51. However, alternative means of engagement may also be used.

It should be appreciated that the thinned out portion 15A may be positioned even lower along the down tube, depending on the design of the bottle collar. In any event, in the FIGS. 3A and 3B embodiment the flexible region 15A is most preferably near the axial middle of the flexible sleeve 15B, with flexible sleeve having overlap on the upper portion of the dip tube so as to be securely positioned.

Figure 5:
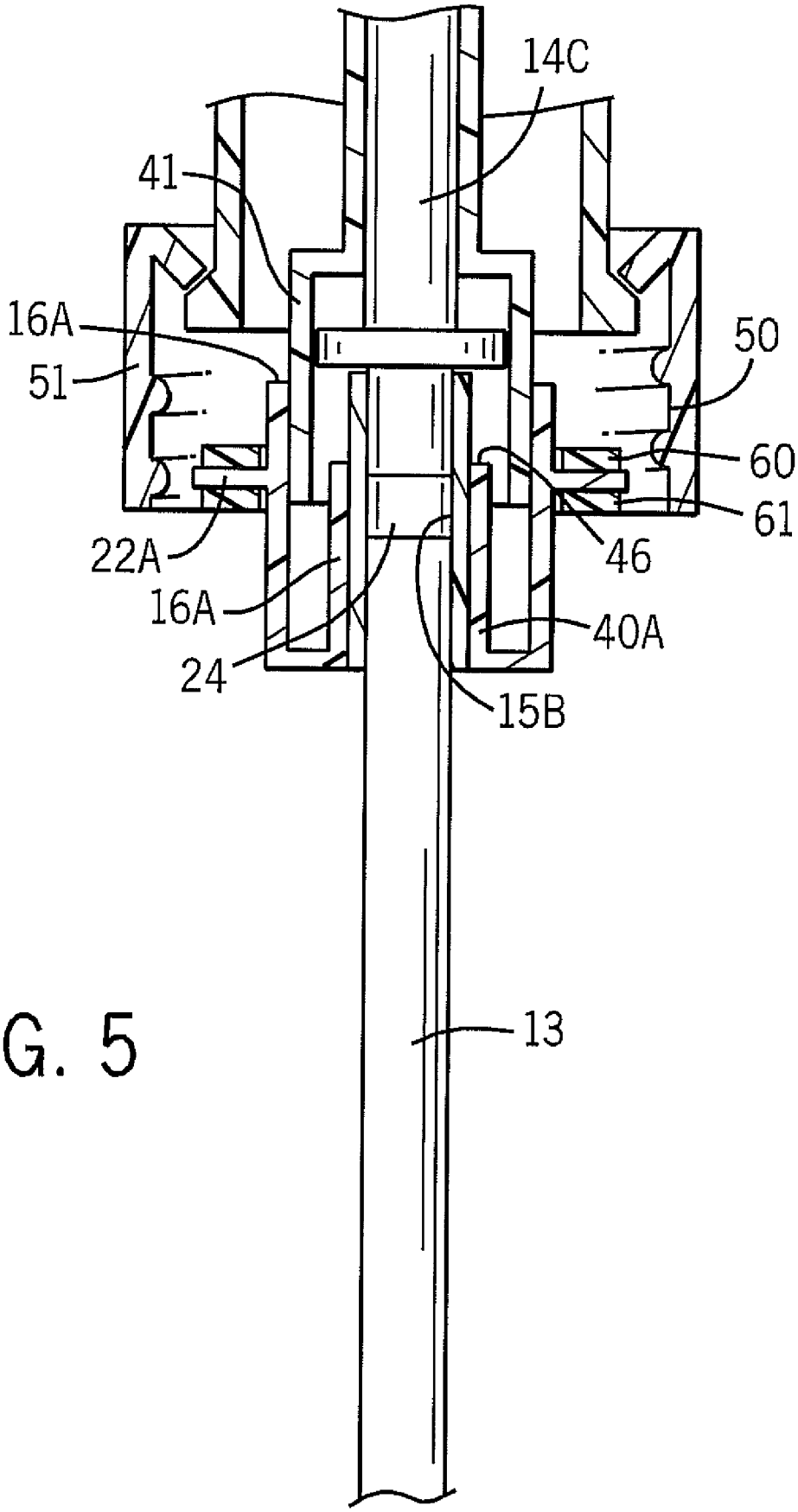
FIG. 5 is a view similar to FIG. 3A but of yet another embodiment of the liquid dispensing device of the present invention.

The FIG. 5 embodiment is similar to that of FIGS. 3A and 3B, except that gaskets 60 and 61 are now present, lower dip tube portion 13 is a separate piece as in the FIG. 2 embodiment, and the upper portion of the dip tube assembly is somewhat modified in that it has a part extending up to make direct connection with the spray head.

While preferred embodiments of the present invention have been described and otherwise disclosed herein, alternative embodiments are also intended to be within the scope of the claims. For example, the integral flexible section 15A of the FIG. 3 dip tube assembly can take other forms than just a thinned out area. It could also be corrugated, like a bellows, somewhat like a flexible hospital-type drinking straw.

In yet another alternative the radial projection/flange can be omitted if the opening to the bottle is sufficiently small. Further, that projection need not be circular or even entirely surrounding.

While a variety of other alternatives are therefore possible, it is believed that the embodiment of FIG. 5 is the most preferred form of the invention for those applications of greatest interest to the applicant. It has certain manufacturing advantages. Further, rigid sleeve 16A can rest underneath the threaded cap 51 when it is capturing the flexible portion of the dip tube and also when it has released the flexible portion of the dip tube. The total distance it travels to release the flexible section of the dip tube can be less than the height of the threaded cap. This helps avoid accidental movement of sleeve 16A relative to the rest of the assembly during shipping, handling, and automatic sorting (prior to the time when it is automatically inserted into the bottle neck).

Thus, the invention is not to be judged solely by the preferred embodiments. Rather, the claims should be looked to in order to judge the full scope of the invention.

INDUSTRIAL APPLICABILITY

The present invention provides flexible down tubes for liquid delivery devices that are designed for automated assembly with their containers, as well as methods for using such devices.

We claim:

1. A liquid dispensing device suitable for use to dispense liquid from a container, the container being of a type having a bottom wall, side wall structure, an internal reservoir cavity and an upper opening, the liquid dispensing device comprising:

a sprayer;

a down tube having an essentially rigid upper section linked to the sprayer, an essentially rigid lower section suitable to extend into the internal reservoir cavity, and an intermediate flexible section; and an essentially rigid sleeve mounted to the down tube so as to move between a first position in which it covers at least a portion of the flexible section so as to restrict pivoting of the lower section relative to the upper section, to a second position in which it permits the lower section to pivot relative to the upper section.

2. The liquid dispensing device of claim 1, wherein the sleeve is formed with a radial projection.

3. The liquid dispensing device of claim 2, wherein the radial projection is in the form of a flange suitable to engage the container adjacent the upper opening to drive the sleeve from the first position to the second position as the lower section of the down tube is being inserted into the internal cavity.

4. The liquid dispensing device of claim 3, wherein the flange is a circular flange.

5. The liquid dispensing device of claim 3, wherein the flange is suitable to engage a lip of the container.

6. The liquid dispensing device of claim 3, wherein the sprayer includes a cap and the flange is positioned within the cap when the sleeve is in the first position.

7. The liquid dispensing device of claim 1, wherein the down tube is a three-piece structure comprising a first rigid tube, a flexible intermediate joining tube, and a second rigid tube.

8. The liquid dispensing device of claim 1, wherein the down tube is a single piece structure with a thinned wall intermediate section.

9. The liquid dispensing device of claim 1, wherein the sprayer is a trigger-operated sprayer.

10. The liquid dispensing device of claim 1, further comprising such a container.

11. The liquid dispensing device of claim 1, wherein the liquid is a cleaning product.

12. A liquid dispensing device comprising:

a container having a bottom wall, side wall structure, an internal reservoir cavity and an upper opening;

a sprayer;

a down tube having a first essentially rigid upper tube linked to the sprayer, a second essentially rigid lower tube suitable to extend into the internal reservoir cavity, and an intermediate flexible tube joining the upper tube and the lower tube; and an essentially rigid sleeve mounted to the down tube so as to move between a first position in which it covers at least a portion of the flexible tube so as to restrict pivoting of the lower tube relative to the upper tube, to a second position in which it permits the lower tube to pivot relative to the upper tube.

13. The liquid dispensing device of claim 12, wherein the sleeve is formed with a radial projection.

14. The liquid dispensing device of claim 13, wherein the radial projection is in the form of a flange suitable to engage the container adjacent the upper opening to drive the sleeve from the first position to the second position as the lower tube of the down tube is being inserted into the internal cavity.

15. The liquid dispensing device of claim 14, wherein the flange is a circular flange.

16. The liquid dispensing device of claim 14, wherein the flange is suitable to engage a lip of the container.

17. The liquid dispensing device of claim 14, wherein the sprayer includes a cap and the flange is positioned within the cap when the sleeve is in the first position.

18. A method of assembling a liquid dispensing device to a container, the container having a bottom wall, side wall structure, an internal reservoir cavity, liquid in the cavity and an upper opening, the method comprising:

obtaining the container;

obtaining a liquid dispensing device having a sprayer; a down tube having a essentially rigid upper section linked to the sprayer, an essentially rigid lower section suitable to extend into the internal reservoir cavity, and an intermediate flexible section; and an essentially rigid member mounted along the down tube;

inserting the down tube into the internal reservoir cavity; and moving the essentially rigid member from a first position in which it restricted pivoting of the lower section relative to the upper section during the inserting step, to a second position where it permits the lower section to pivot relative to the upper section in the internal cavity.

19. The method of claim 18, wherein the moving step is caused automatically by the inserting step.

20. The method of claim 19, wherein during the moving step a flange of the rigid member contacts the container adjacent an upper opening of the container to thereby restrict downward movement of the flange so as to permit the rigid member to move upward along the down tube as the down tube is inserted in the internal cavity.

* * * * *